United States Patent [19]

Standerwick et al.

[11] Patent Number: 4,839,180

[45] Date of Patent: Jun. 13, 1989

[54] PACKAGE FOR STORING, HEATING AND DISPENSING A MEAL

[76] Inventors: Antony R. Standerwick, 16 Albion Road, Selsey, Chichester W. Sussex, Great Britain, P020 0DH; Antony J. Standerwick, Beggar's Roost, High St., Selsey, Chichester, W. Sussex, Great Britain, P020 0RD

[21] Appl. No.: 26,719

[22] PCT Filed: Jul. 4, 1986

[86] PCT No.: PCT/GB86/00390

§ 371 Date: Apr. 29, 1987

§ 102(e) Date: Apr. 29, 1987

[87] PCT Pub. No.: WO87/00150

PCT Pub. Date: Jan. 15, 1987

[30] Foreign Application Priority Data

Jul. 9, 1985 [GB] United Kingdom ..... 8517383
Mar. 7, 1986 [GB] United Kingdom ..... 8605645

[51] Int. Cl.[4] ..... B65D 33/36; B65D 65/30

[52] U.S. Cl. ..... 426/115; 426/113; 426/394; 426/412; 426/393; 383/67

[58] Field of Search ..... 426/106, 115, 120, 393, 426/112, 132, 412, 394, 113; 206/469, 531, 532, 219, 222; 229/905

[56] References Cited

U.S. PATENT DOCUMENTS

| | | | |
|---|---|---|---|
| 2,321,519 | 6/1943 | Rubinoff | 426/132 |
| 2,768,086 | 10/1986 | Bliley | 426/393 |
| 2,951,765 | 9/1960 | Robson | 426/113 |
| 3,042,532 | 7/1962 | Daline | 426/412 |
| 3,108,731 | 10/1963 | Royce | 426/106 |
| 3,230,864 | 1/1966 | Krajewski | 426/243 |
| 3,326,363 | 6/1967 | Bennett et al. | 426/115 |
| 3,336,142 | 8/1967 | Lawson | 426/241 |
| 3,451,540 | 6/1969 | Kulischenko | 426/222 |
| 3,453,661 | 7/1969 | Repko | 426/115 |
| 3,477,614 | 11/1969 | Runge | 426/115 |
| 3,505,490 | 4/1970 | Gorn | 426/241 |
| 3,594,177 | 7/1971 | McGowan | 426/115 |
| 3,689,291 | 9/1972 | Draper | 426/113 |
| 3,759,371 | 9/1973 | Marks | 206/531 |
| 3,924,009 | 12/1975 | Goldberg et al. | 426/115 |
| 3,969,535 | 7/1976 | Bourns | 426/111 |
| 4,166,208 | 8/1979 | Martel et al. | 426/243 |
| 4,265,919 | 5/1981 | Munter | 426/393 |
| 4,299,851 | 11/1981 | Lowe | 426/113 |
| 4,484,350 | 11/1984 | Gordon | 426/112 |
| 4,574,174 | 3/1986 | McGonigle | 426/118 |
| 4,596,713 | 6/1986 | Burdette | 426/120 |

FOREIGN PATENT DOCUMENTS

| | | |
|---|---|---|
| WO8300677 | 3/1983 | PCT Int'l Appl. . |
| 661820 | 11/1951 | United Kingdom . |
| 1463094 | 2/1977 | United Kingdom . |

*Primary Examiner*—Steven Weinstein
*Attorney, Agent, or Firm*—Walter C. Farley

[57] ABSTRACT

The heating of food from a chilled or frozen state to provide a prepared meal is becoming increasingly useful in the catering field, and to facilitate such preparation a heatpack base sheet for use in making a pouch forming a virtually enclosed pack containing a prepared meal is provided, whose form facilitates the necessary heating of the meal in a favourable manner enabling a hot meal to be conveniently served in a time-saving manner on a warm plate, without time being taken up in disposing the ingredients attractively, or in removing the browned outer ring often formed when a microwave oven is used for appropriate heatings. The proposed base sheet may be of electrically non-conductive synthetic resin, if intended for use in a microwave oven, or may be of conductive foil if the meal is to be defrosted in a thermally-heated oven. A hole may be provided in the centre of the base sheet, surrounded by radially-extending slits to form a tongue or tongues which enable the meal to pass through onto a plate when the heatpack formed by a pouch comprising the base sheet is lifted. An underlay may be provided to assist in securing the packed food in place in an attractive array, but allow it to pass out of the pack when heated. Alternative constructions of the heatpack are described, together with methods for serving from a microwave oven or a thermally-heated oven, or to serve as a cold meal of delicate foodstuff after storage chilled or frozen and subsequently allowed to heat up to ambient room temperature.

16 Claims, 2 Drawing Sheets

PACKAGE FOR STORING, HEATING AND DISPENSING A MEAL

This invention relates to heatpacks for food, to be used in forming an integral part of the packaging, and also facilitate serving of food, such as pre-cooked or prepared meals.

Heating food from a frozen state is becoming an increasingly valuable method in both the catering and the domestic kitchen, using any type of oven. A particular advantage is offered by microwave ovens, because of their ability to defrost and cook food from the frozen state in a relatively short time, and this is particularly advantageous in the case of reheating a pre-cooked meal, when the time required becomes very short. However, there is a tendency for a pre-prepared meal so treated to overheat at its edges and form a dried ring around the dish before the centre is sufficiently hot, which is most unattractive. Thus, to ensure good presentation, it is necessary to transfer the hot meal from the heating dish to a clean pre-warmed plate before serving, removing the dried portions in the process, which can be time-consuming, especially as the components of the meal need to be reassembled in an attractive array, if the maximum culinary effect is to be achieved. In the case of a thermal oven the meal may be heated on a suitable dish or tray for convenience, and then transferred to a serving plate.

In the case of a packed food that has been stored in a refrigerated or a chilled condition, and is to be served cold, the pack serves to retain and protect the contents during the period required to bring it to room temperature after removal from a storage refrigerator or freezer, and the context of this Specification can be termed a "heating period".

One object of the present invention is to facilitate the serving of prepared food, particularly cooked meals defrosted and reheated on the serving plate, thus enabling an attractive meal to be rapidly served in a convenient manner, whilst avoiding some of the problems normally encountered.

Where used with a microwave oven the food can be defrosted and prepared for serving on its serving plate, as heat induced into the food by the microwave radiation will warm the plate by thermal conduction during the defrosting and heating of the food. In the case of a thermally-heated oven it is normally more convenient to use an oven dish, because a serving plate could become too hot, and therefore it may remain necessary to transfer the heated meal on to a warmed plate for serving, but this process can also be facilitated in exemplary embodiments of the invention.

In accordance with one aspect of the invention there is provided a heatpack base sheet comprising a number of tongues of foil or film of a material suitable for use with predetermined foodstuffs, said base sheet being provided to retain chilled or frozen food contained in a heatpack pouch formed using said base sheet, but opening freely to permit the passage of said food through the resultant hole onto a serving plate when said food has been heated as required.

According to another aspect the present invention consists in a method of serving food comprising the steps of arranging food in an appetising array on a thin base sheet of film or foil that is formed in accordance with the first aspect, the food being arranged to cover the tongue or tongues, and then wrapped in a pouch formed using said base sheet, subsequently heating said pouch as necessary, and when ready for serving, lifting the pouch to allow the contents to pass through the opening and lie in an attractive predetermined array on said plate.

Partially enclosing the meal in a foil or film cut in such a fashion, with a hole beneath the meal large enough to allow easy removal of such a meal, yet small enough to prevent seepage during reheating, assists even heating, and prevents the formation of a ring of burnt food on the plate. If only a single tongue is provided, then it will be formed by a narrow cut extending around three-quarters of the periphery of the base member, to lie contiguous with a marginal zone forming part of a completed heatpack pouch, or constituting an integral part thereof.

If there is a plurality of tongues, then their neighbouring edges will lie substantially contiguous, and may extend so that the tips are each contiguous with a tip of one or more of the other tongues. Many configurations can be used, and the pattern of the cuts and the shaping of the tongues can be selected in accordance with the particular food that is to be contained in a pouch.

A preferred configuration has radially-extending slits meeting at a central point to form a ring of tongues, each extending to that point. In an advantageous modification that has been found to be advantageous with some food combinations is a ring of such tongues, truncated to form a generally circular central aperture.

For use in microwave ovens the heatpack pouch will be formed with a base member that is of an electrically non-conductive material, and if seepage is found to be a problem an underlay of imperforate material may be applied to the under surface of the pack to hold the tongues in position during storage. However, such an underlay has no real function during defrosting and heating, and would need to be removed from the serving plate without disturbing the heated food, and therefore it may be removed from the pack before the pouch is placed on its serving plate and inserted in the microwave oven.

For use in thermally-heated ovens of any type, the heatpack pouch can be of electrically-conductive material, and a metallic foil is commonly used in making conventional trays or dishes for frozen food. In embodiments constructed in accordance with the invention, such material can be ued, provided with the tongue or tongues, if the pouch pack is an integral monolithic structure of a material thin enough to give tongues of the requisite flexibility to allow free passage for the heated food. To complete a two-part pack a base member with tongues can be combined with a cover member, which can be electrically conductive if the pack is to be used in a thermal oven. Alternatively, a non-conductive film can be used for a cover, such as may be used in embodiments intended for microwave ovens. Materials are now available that are suitable for either type of oven, and if so desired, a heatpack in accordance with the invention can be used employing such materials.

More significantly, as the use of a thermal oven involves heating the tray or dish on which the pouch is positioned to an uncomfortable temperature, it is advantageous in a thermal oven application to use an oven tray or dish and transfer the meal to a warm serving plate. The presence of an underlay is then doubly advantageous, as it will provide strength and protection for the tongues during storage, and facilitate transfer of the pack from the oven dish or tray to the serving plate before the underlay is peeled away and the pouch lifted to deposit the food on the plate.

Thus, there is an advantage in the use of a metallic foil underlay in all cases, as the user will be naturally inclined to remove such a foil from a frozen pack before inserting the pouch into a microwave oven, and this instinctive approach will significantly reinforce any printed instructions or warnings that may be provided on the pouch or any outer packaging.

In the case of a thermally-heated oven such a metallic foil underlay can be assumed to be readily acceptable to the user, and will be left in position so that it provides a useful safeguard against seepage as a heated pouch is transferred to its serving plate, after which the underlay can be pulled away from under the pouch. The underlay can be provided with an extending tag or strip on which instructions are provided, and which will serve as a gripping member to facilitate removal.

The heatpack may incorporate a rigid cover, or reinforcing frame or ring to which the base member is attached or which is enclosed within the pouch.

The elements required to make up a heatpack could be sold as a kit of parts for domestic use, enabling a housewife to prepare and store a number of meals at a convenient time for use later, for example, but the major fields of use are thought to be the retail trade and catering field.

BRIEF DESCRIPTION OF THE DRAWINGS

The invention will now be described with reference to the drawings, in which.

Figure 1:
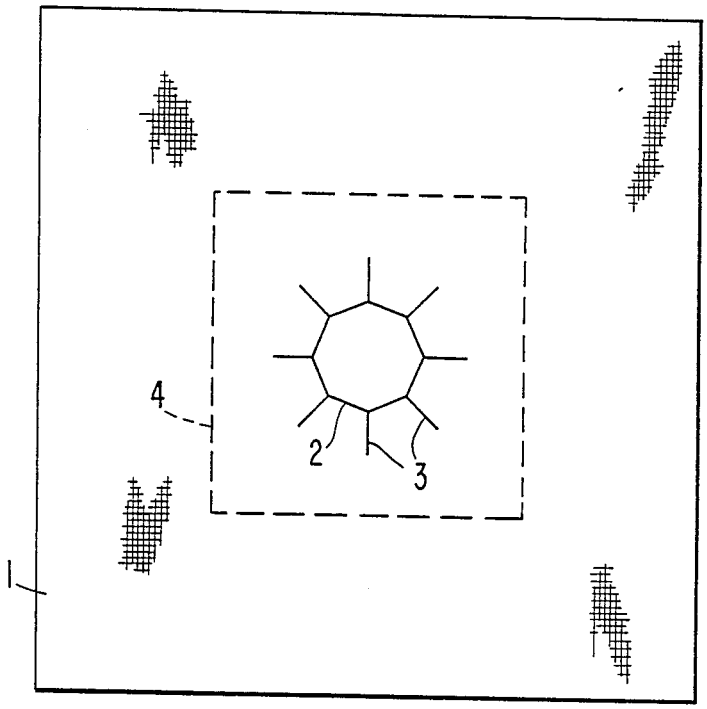
FIG. 1 is a plan view of a base member sheet laid flat over an optional secondary underlay to constitute an open pouch in one exemplary embodiment of the invention.

The invention is applicable to packs or pouches of material suitable for use in any form of thermal oven chamber, or of material suitable for microwave ovens, or by choice of the appropriate materials, packs or pouches may be formed for use in either type of oven, using a thermally-heated chamber, or inducing heat by microwave radiation. For simplicity we will first consider an exemplary embodiment designed for microwave use, with reference to FIG. 1.

A base member 1 of electrically non-conductive transparent synthetic resin film has a generally circular hole 2 at its centre, and this is surrounded by a plurality of contiguous, truncated tongues formed by the provision of radially-extending slits 3. For storage this may be laid on a simple underlay sheet 4, of an appropriate, non-toxic synthetic resin, as shown by a broken line rectangle in the drawing. In this embodiment a cooked meal 5 is then assembled centrally on the pouch exactly as it will eventually appear on the plate, so that the hole 2 and radiating slits 3 are covered by a margin of 3 to 4 cm., as shown in FIG. 2*a*, and the edges of the sheet 1 are then folded over the meal 5 in parcel fashion and secured with a plastic clip or similar means (not illustrated) to complete the pouch, after which, the entire assembly can then be frozen or chilled for storage, as the case may be.

If frozen, the lower film underlay 4 may be peeled away, leaving the remaining pouch with its contents to be packed in an airtight outer cover (not shown), or if preferred, the film underlay 4 may remain as part of the original package, and may carry a notice that it needs to be removed before heating in the case of a microwave oven embodiment, or to be removed after the reheating step has been accomplished, in the case of a thermally-heated oven embodiment. As a further alternative, the underlay can be attached to, or form an integral part of, the sheet 1, folded back underneath as a flap to form an underlay that will be removed together with the base sheet 4 when the meal has been defrosted and heated, as will be described.

Figure 2A:
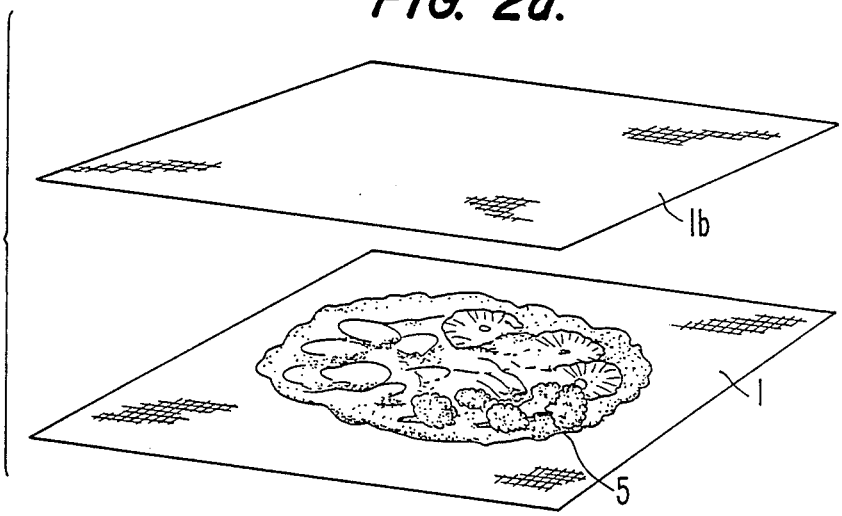
FIG. 2*a* is a partly exploded view showing a precooked meal in position on an open pouch base member, and an associated cover sheet prior to assembly to form a closed pouch.
Figure 2B:
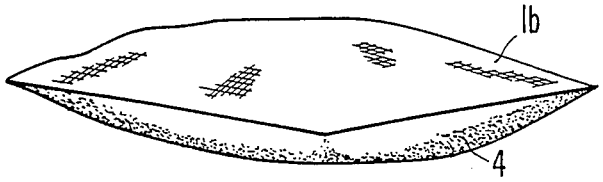
FIG. 2*b* is a simplified perspective view of an assembled pouch ready to be frozen and further packaged.

FIG. 2*a* shows details of a modified exemplary embodiment, in which the meal 5 is laid on a base sheet of a size sufficient to leave an adequate margin around the meal, and a cover sheet 1*b* is then laid over the assembly and sealed to the base sheet at or near its outer edges to form a pouch 1*c*, as shown in FIG. 2*b*. In this case the underlay 4 can be a flap on the base sheet 1 or the cover sheet 1*b*, by appropriate positioning before the meal is put into place.

To heat a frozen or chilled meal, the pouch and its contents are removed from the outer pack and placed on a serving plate 6, which will need to be heat-resistant if a normal fuel-burning type of oven is used, but merely non-conductive electrically if used in a microwave oven. The covered, but not sealed, effect of the folded pouch will allow the enclosed food to heat more evenly than if heated in an open dish, and, as the edge of the food is in contact with the pouch and not the plate, no unsightly ring will show around the perimeter of the finished meal.

Figure 3:
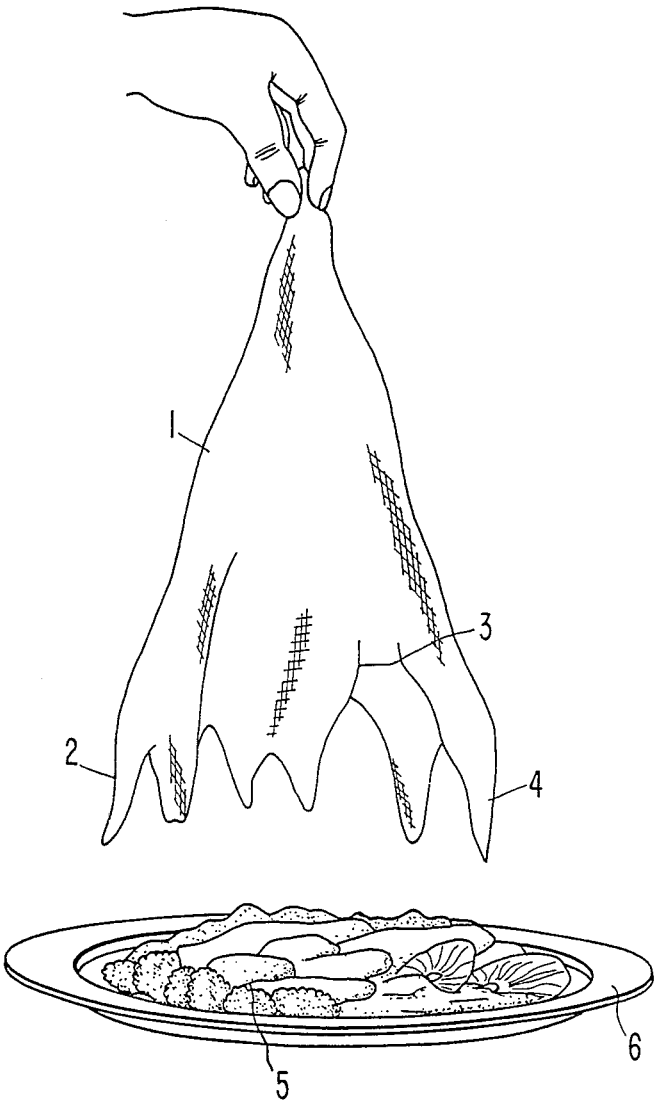
FIG. 3 is a front view of a reheated meal being removed from the pouch.

After removal from the oven, the pouch is removed from the meal 5 by carefully lifting the pouch upwards, as illustrated in FIG. 3, the hole and radiating slits 2 and 3 then forming an opening large enough to allow removal with minimal disturbance to the food, leaving a finished meal 5 with a freshly-prepared appearance served on a clean hot plate 6.

The pouch in this embodiment is made of a flexible synthetic resin film with non-toxic properties, that is stable at temperatures between −30° C. and 120° C., such as is commonly used in the manufacture of "boil in the bag" covers.

The overall size of the open pouch should be such as to allow its edges to be folded neatly over to fully cover the food with sufficient excess to accommodate the chosen means of fastening, if the separate cover sheet 1*b* shown in FIG. 2*a* is not used.

A further alternative is the use of a base sheet 1 that has an extension at one edge adequate to form a cover sheet when folded over, after the meal has been put into position. The folded material can then be sealed around the periphery to form the required pack. The underlay can be sealed to the base sheet in the same operation, if it is not an integral flap on the base sheet 1. In order to ensure a minimum disturbance of the cooked meal during removal of the pouch, an underlay can be formed by two flaps that slightly overlap below the centre of the hole 2, and such flaps can be integral with the base sheet to extend one from each of two opposed edges, or, if separate from the base sheet, can be pre-arranged to be suitably sealed at two opposed edges as the cover sheet is sealed.

By way of example, the width of the opening formed by the hole 2 and the radiating slits 3 should be 6 to 8 cm smaller than that desired for the finished diameter of the meal 5, to prevent seepage during reheating, and the diameter of the hole 2 should be such as to allow the tongues formed between the radiating slits 3 to be sufficiently long to be held in place by the weight of the meal 5, before and during freezing, whilst not being so long as to cause excessive disturbance to the finished meal 5 on removal. It will be readily apparent to the skilled reader that the precise dimensional relationships of hole, slits and the pre-positioned meal will be dependent to some degree on the nature of the foodstuffs.

If the packed meal is not intended for defrosting in a microwave oven, then one or more sections of the pack can be of a thin metallic foil or metallised synthetic resin film, although it is normally preferable to have a transparent cover to enable the meal to be visible for inspection before cooking or defrosting, as the case may be. Should the nature of the food, or the desired shape of the meal require it, an outer frame or ring-shaped member can be positioned on the base sheet to surround the meal and support the cover. This can be a reinforcing attachment to the base sheet, or a separate item, to be removed after the covering has been removed. It may consist of foil, if not intended for microwave ovens, or a suitably-selected synthetic resin collar if it is required to be suitable for any type of oven. If desired, the cover can be a monolithic dome or inverted dish, in which case a base sheet member is attached to the bottom rim of this one-piece cover, or of a ring or frame. A base member can then be formed by a plurality of discrete, separate tongues positioned to extend inwardly from the bottom rim.

Such constructions as have been described above are also particularly suited for packs required to store delicate foodstuffs that are not to be served hot, but merely allowed to heat up to the ambient room temperature and served cold. The choice of foil or film material will obviously be primarily determined by the requirement for storage of the foodstuff in this case.

We claim:

1. A package for storing, heating and dispensing a prepared meal comprising an enclosure made of a flexible material capable of retaining food at a reduced temperature and also capable of withstanding food-heating techniques and temperatures without significant degradation, said enclosure including a base sheet including an unperforated peripheral portion and a generally central portion with means defining a plurality of generally radial cut lines forming a plurality of edge-to-edge tongues extending inwardly from said peripheral portion toward a central point to substantially close said central portion of said base sheet, and a cover portion extending from said base sheet to complete said enclosure; and a prepared meal arranged within said enclosure on said base sheet, said meal being storable in said enclosure at reduced temperature, heatable in said enclosure without significant modification of said enclosure and dispensable from said enclosure onto a serving dish said cut lines and tongues being configured such that after thawing or heating of said meal and upon lifting the enclosure upwards, the weight of said meal causes the radial cut lines to automatically form an opening sufficiently large to allow said meal to dispense itself from said enclosure with minimal disturbance to the meal such that said meal is sewed in substantially the same arrangement as said meal occupied while stored in said enclosure.

2. A package as claimed in claim 1, in which said tongues are truncated to leave a central hole.

3. A heatpack member as claimed in claim 2, in which said flexible material is an electrically-conductive foil or metallised film suitable for use in a thermally-heated oven.

4. A package as claimed in claim 1, in which said enclosure is a film of a synthetic resin material that is electrically non-conductive.

5. A heatpack member as claimed in claim 4, in which said synthetic resin material is suitable for use in a thermally-heated oven.

6. A package according to claim 1 wherein said enclosure further comprises an underlay sheet positioned beneath said central portion of said base sheet before said meal is arranged on said base sheet.

7. A package as claimed in claim 6, in which said underlay is of the same material as said base sheet.

8. A package as claimed in claim 7, in which said underlay is an integral extension from one edge of said base sheet.

9. A package as claimed in claim 7, in which said underlay is formed by two overlapping portions extending from opposed edges of said base sheet.

10. A package as claimed in claim 9, in which said underlay is securely attached to said enclosure so as to be removed with the base sheet when said pouch is heated and the meal ready for serving.

11. A package as claimed in claim 10, in which said cover portion is formed by folding the outer edges of said base sheet over said prepared meal until said outer edges overlap and securing the overlapped edges together to form a sealed cover.

12. A package as claimed in claim 10, in which said cover portion is formed by positioning a separate cover sheet over the prepared meal and sealing the edges of said separate sheet to the peripheral edges of said base sheet.

13. A package as claimed in claim 12 in which said enclosure further includes a reinforcing upstanding collar positioned upon said base sheet to surround said meal within said enclosure.

14. A package as claimed in claim 13, in which said tongues are discrete films secured to the bottom rim of said rigid member.

15. A package as claimed in claim 6 wherein said underlay is initially separate from said base sheet and is attached thereto during the sealing of said cover portion.

16. A package according to claim 13 wherein said enclosure further includes a substantially rigid inverted dome-shaped dish serving as a food cover to complete said enclosure.

* * * * *